US006704986B1

(12) United States Patent
Liu

(10) Patent No.: US 6,704,986 B1
(45) Date of Patent: Mar. 16, 2004

(54) AIR OVER OIL RIVETER WITH ROTATABLE HEAD PIECE

(76) Inventor: Pao-Fang Liu, No. 7, Lane 4, Guang Sheng Hsin Town, Guang Sheng Village, San-Yi Village, San-Yi Hsiang, Miao Li Hsien (TW)

( * ) Notice: Subject to any disclaimer, the term of this patent is extended or adjusted under 35 U.S.C. 154(b) by 0 days.

(21) Appl. No.: 10/414,040

(22) Filed: Apr. 16, 2003

(51) Int. Cl.[7] ..... B21J 15/04; B21J 15/34

(52) U.S. Cl. ..... 29/243.525; 29/243.521; 72/391.4

(58) Field of Search ..... 29/243.521, 243.523, 29/243.524, 243.525, 243.528; 72/391.4

(56) References Cited

U.S. PATENT DOCUMENTS 4,580,435 A * 4/1986 Port et al. ..... 72/391
5,050,420 A * 9/1991 Liu ..... 29/391.4
2002/0194720 A1 * 12/2002 Ko ..... 29/243.521

* cited by examiner

*Primary Examiner*—David B. Jones
(74) *Attorney, Agent, or Firm*—Rosenberg, Klein & Lee

(57) ABSTRACT

An air over oil riveter with a rotatable head piece includes a head piece, a handle, two rotatable members, a connecting sleeve with a hollow body, an oil sleeve, and a main body. The head piece includes an bore for receiving an outer sleeve and a driving sleeve housed in the outer sleeve. The front of driving sleeve has a joint for connecting the rivet-pulling apparatus. The rivet-pulling apparatus is disposed in a housing of the head piece. The bottom of the head piece has a first inclined plane, and the front of the handle has a second inclined plane disposed in opposition to first inclined plane. Two rotatable members are respectively coupled to the first and second inclined planes. The connecting sleeve connects through an oil path of the handle and two rotatable members to the head piece by a nut fastened on the screw thread of the front of the connecting sleeve.

12 Claims, 8 Drawing Sheets

AIR OVER OIL RIVETER WITH ROTATABLE HEAD PIECE

BACKGROUND OF THE INVENTION

1. Field of the Invention

The present invention is related to an air over oil riveter, and more particularly, to an air over oil riveter with a rotatable head piece which has two rotatable members connecting between a head piece and a handle for rotation.

2. Description of the Prior Art

The conventional riveter is used to join plate components in industry or for decorative effects. First, holes in the overlap of plate components are drilled and then rivets are used to join the plates with a riveter. When the operator presses the trigger of the riveter, the head will move back so that the main body of rivet deforms for fastening the plate components.

Therefore, the head and handle of conventional riveter are one piece so that the head cannot rotate at any angles during operation. The limitation of the conventional riveter where the head of the riveter cannot rotate, is a disadvantage for its use.

SUMMARY OF THE INVENTION

It is an object of the present invention to provide an air over oil riveter with a rotatable head piece which uses two rotatable members connecting between the head piece and the handle.

It is another object of the present invention is to provide an air over oil riveter with a rotatable head piece which can change the rivet-pulling apparatus.

The riveter of the present invention comprises a head piece, a handle, two rotatable members, a connecting sleeve with a hollow body, an oil sleeve, and a main body. The head piece includes an opening for placing an outer sleeve and a driving sleeve, where the driving sleeve is housed in the outer sleeve. The front of the driving sleeve has a joint for connecting the rivet-pulling apparatus. The rivet-pulling apparatus is disposed in a housing of the head piece. The bottom of the head piece has a first inclined plane with a first positional hole, and the front of the handle has a second inclined plane disposed in opposition to first inclined plane and having a second positional hole aligned with the first positional hole. And, two rotatable members are respectively coupled to the first and second positional holes. The connecting sleeve connects through an oil path of the handle and the two rotatable members to the head piece by a nut fastening on the screw thread of the front of the connecting sleeve. Further, the oil sleeve is disposed in the hollow of connecting sleeve, the front of which connects to a channel of the head piece and the rear of it connects to the oil path of the handle.

During the rivet-pulling operation, when the trigger is pressed, the oil will flow from the oil path through the oil sleeve to the channel. The oil pushes the outer sleeve back with the driving sleeve because the flange of the outer sleeve jams the flange of the driving sleeve. When the driving sleeve moves back, the rivet-pulling apparatus will move back in correspondence therewith to complete the rivet-pulling operation. And, the head piece can rotate to any angles to accommodate the operating space.

BRIEF DESCRIPTION OF THE DRAWINGS

The above and further objects, features and advantages of the invention will become clear from the following more detailed description when read with reference to the accompanying drawings in which.

DETAILED DESCRIPTION OF THE PREFERRED EMBODIMENTS

Figure 1:
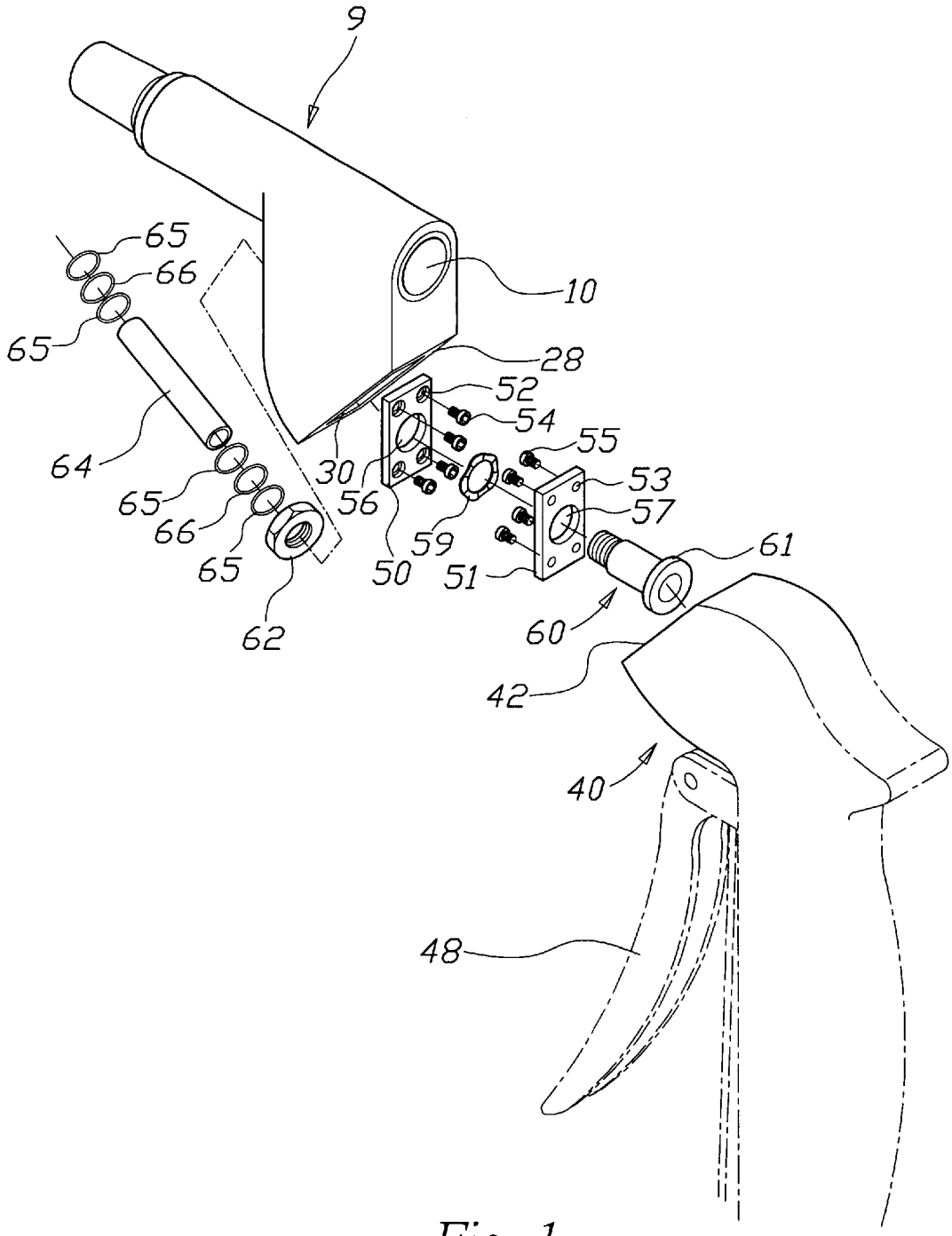
FIG. 1 is a explosive view for head piece and handle of the prior art.
Figure 2:
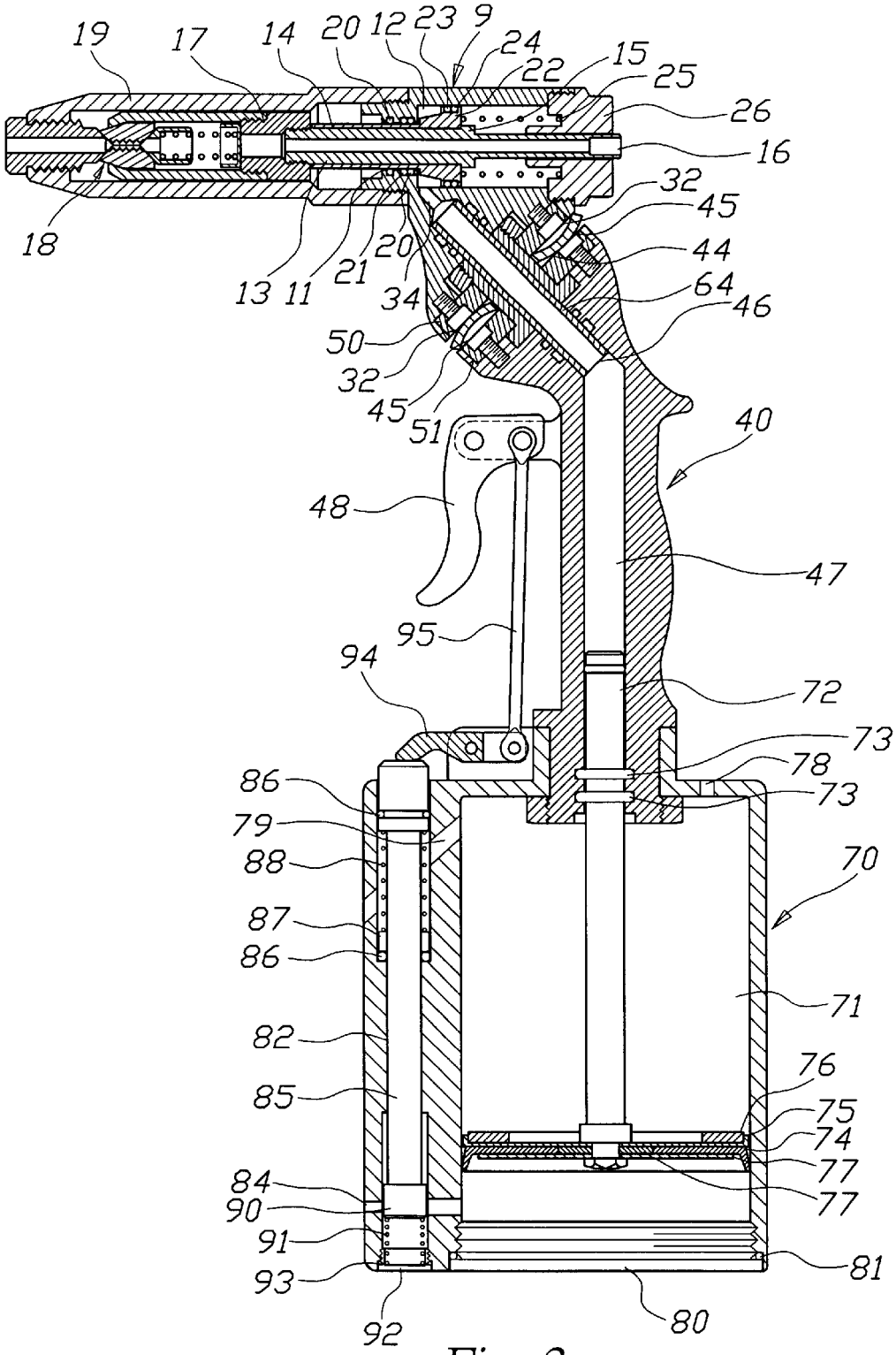
FIG. 2 is a perspective view of the present invention.

Refer to FIGS. 1 and 2, the riveter of the present invention comprises a head piece 9 with a bore 10 horizontally extending between the front and rear of hand piece 9. The bore 10 has respective front and rear openings 11 and 12, with the diameter of the front opening 11 being smaller than the rear opening 12. The bore 10 receives a driving sleeve 13 and an outer sleeve 14 therein, with the driving sleeve 13 housed in the outer sleeve 14. The rear of the driving sleeve 13 has a hex socket cap screw 16 to be easily operated by a hex tool. The front of driving sleeve 13 extends out of the outer sleeve 14 to connect with a joint 17 which couples a rivet-pulling apparatus 18 thereto. The front of head piece 9 has a housing 19 for fastening the rivet-pulling apparatus 18. And, the wall of front opening 1I1 of bore 10 tightly connects to the outer sleeve 14 by at least one o-ring 20 and a pad 21 for preventing oil from leaking. The rear of outer sleeve 14 has a flange 22. The diameter of flange 22 is larger than the front opening 11 of bore 10. Further, the wall of the rear opening 12 of bore 10 tightly connects to the flange 22 of outer sleeve 14 by at least one o-ring 23 and a pad 24 for preventing the oil from leaking. The rear of outer sleeve 14 contacts a spring 25 that is disposed between the outer sleeve 14 and a cover 26 of the head piece 9.

The bottom of the head piece 9 has a first inclined plane 28 with a bottom opening 30 having a centrally disposed channel 34 and a plurality of screw holes 32. The bottom opening 30 connects to the rear opening 12 by the channel 34 at the front of flange 22 of outer sleeve 14.

A handle 40 has a second inclined plane 42 disposed in opposition to the plane 28. The inclined plane 42 has a front opening 44 aligned with the bottom opening 30 and a plurality of screw holes 45. The center of front opening 44 has a hole 46 for connecting to an oil path 47. Further, the handle 40 has a trigger 48.

Two rotatable members 50, 51 are respectively disposed at the bottom and front openings 30, 44 and have a plurality of screw holes 52, 53 and positional holes 56, 57. The two rotatable member 50, 51 are respectively coupled to the bottom opening 30 of head piece 9 and the front opening 44 of handle 40 by a plurality of screws 54, 55. The flange 61 of a connecting sleeve 60 is disposed in the handle 40, and the connecting sleeve 60 connects through the positional holes 56, 57 of the two rotatable members 50, 51 to the head piece 9 by a nut 62 being fastened to the front screw thread of the connecting sleeve 60. The two rotatable members 50, 51 have a wave pad 59 between them for increasing the localization effect.

An oil sleeve 64 with a hollow passage is disposed in the connecting sleeve 60, and front and rear of the oil sleeve 64 respectively connect to the channel 34 of head piece 9 and the oil path 47 of handle 40. And, the front and rear of the oil sleeve 64 respectively have at least one o-ring 65 and pad 66.

A main body 70 is located at the bottom of the handle 40 and has an air chamber 71 including a piston rod 72. The front of piston rod 72 is located in the oil path 47 and has at least one o-ring 73. The rear of piston rod 72 connects to a piston 74. The top of the piston 74 has a fastening member 75 positioning a shockproof member 76 at the side thereof. The center of piston 74 and bottom of piston 74 respectively have a pad 77. The top and side wall of air chamber 71 respectively have vent holes 78, 79. Further, the bottom of air chamber 71 has a cover 80 with an o-ring 81.

The side of air chamber 71 has a hole 82, the bottom of hole 82 having an inlet 84 for a path of air between air chamber 71 and outside of main body 70. A hole 82 has a pull rod 85 therein. The top of rod 85 has an o-ring 86, a ferrule 87 and a spring 88. The bottom of pull rod 85 has a plug 90 for the vent hole 84. The bottom of plug 90 has a spring 91. The bottom of hole 82 has a cover 92 with an o-ring 93. The main body 70 has a lever member 94 at the same side as hole 82 connecting to a pull rod 95 which coupled to the trigger 48 of the handle 40. And, the other side of lever member 94 presses the top of the rod 85. Therefore, when the trigger 48 is pressed, the plug 90 leaves the inlet 84 so that the outside air can enter into the air chamber 71 through the inlet 84.

Figure 3:
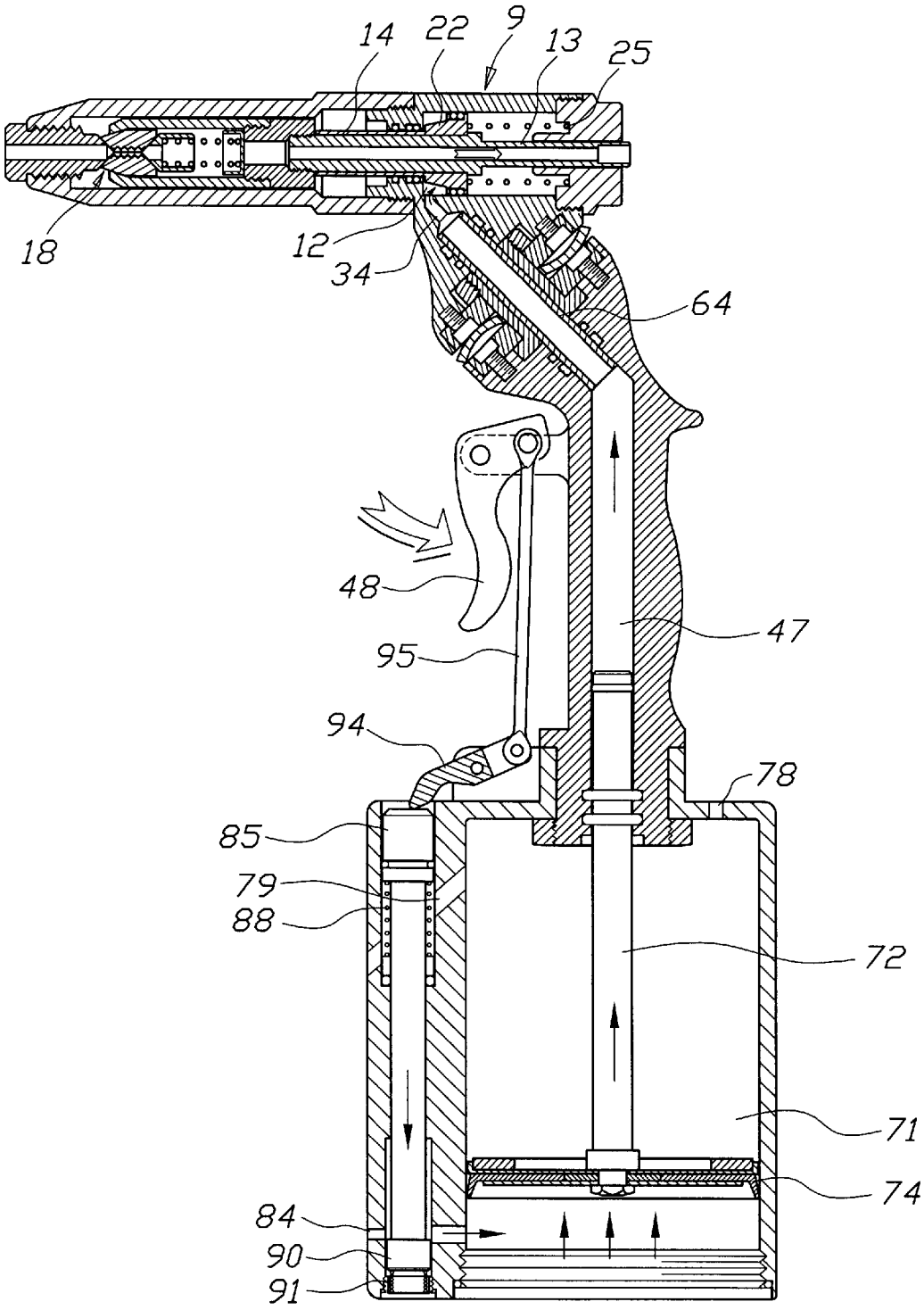
FIG. 3 is an illustrated view for the riveter working of the present invention.

Referring to FIG. 3, during the rivet-pulling process, when the trigger 48 is pressed by operator, the trigger 48 moves the rod 95 upwardly and the rod 95 displaces the lever member 94 to press down the rod 85. The rod 85 can move the plug 90 leaving the inlet 84 exposed for outside air to enter into the air chamber 71. The piston 74 is moved up by the air so that the rod 72 moves up to push oil in the oil path 47. The oil passes through the oil sleeve 64 to the channel 34 and flows into the opening 10 of head piece 9. When the oil is pushed by air, the flange 22 of outer sleeve 14 is moved back with the driving sleeve 13 by oil so that the rivet-pulling apparatus 18 is moved back by the driving sleeve 13. And, when the trigger 48 does not have any force, the springs 88 and 91 can go back to a no compression state, returning the rod 85 and plug 90 to their original position. During the decreasing air pressure, the spring 25 pushes the flange 22 of outer sleeve 14 returning the driving sleeve 13 and rivet-pulling apparatus 18 to their original position. The flange 22 forces the oil to flow from the opening 10 through the oil sleeve 64 to the oil path 47. Therefore, the rod 72 and piston 74 are moved to their original state by the oil.

Figure 4A:
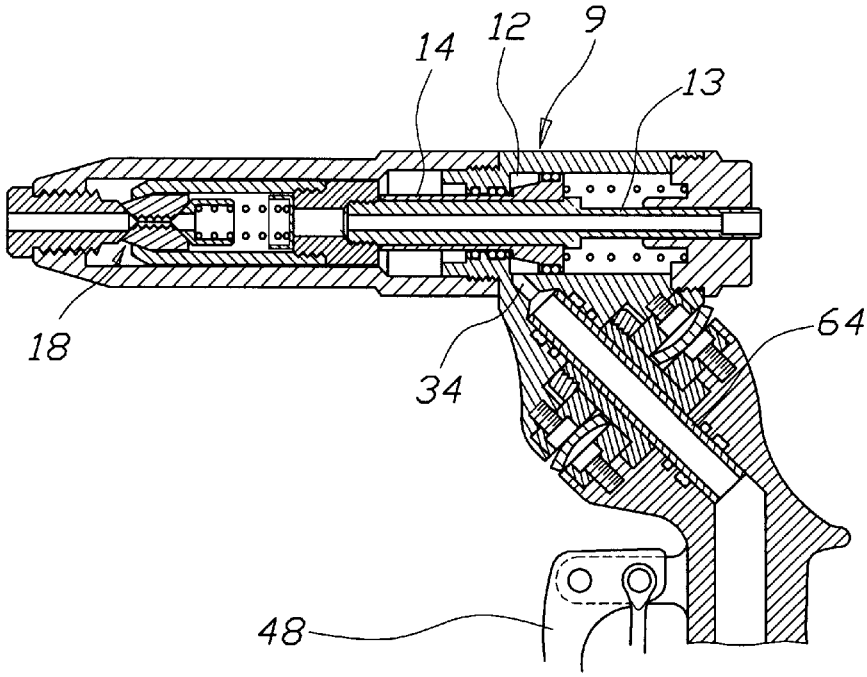
FIG. 4A is a perspective view for the head piece working of the present invention.
Figure 4B:
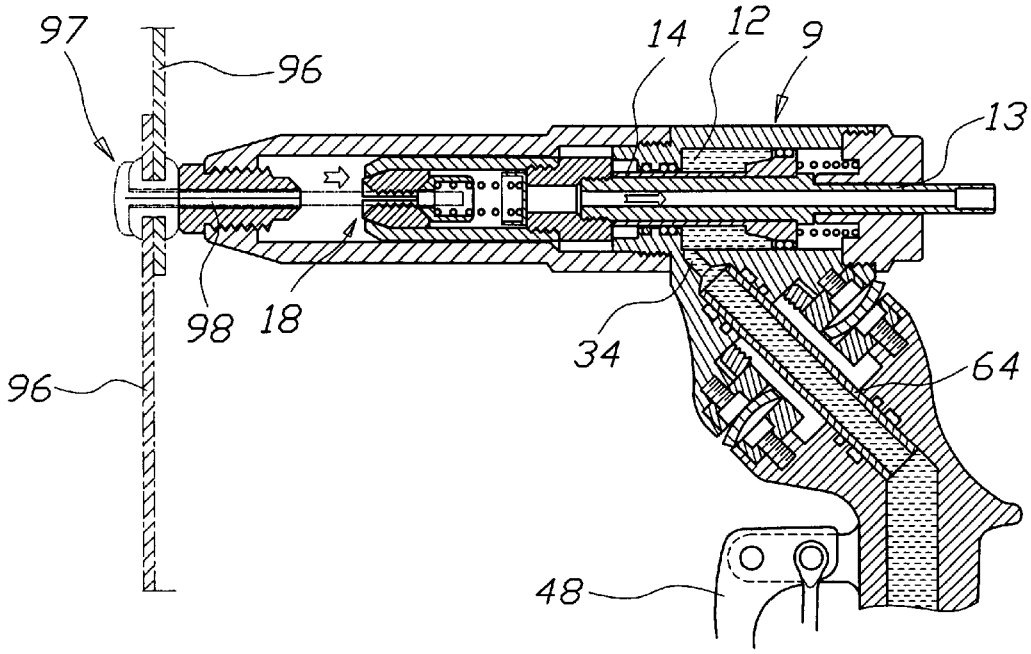
FIG. 4B is a perspective view for the rivet-pulling apparatus working of the present invention.

Refer to FIGS. 4A and 4B, when the rivet-pulling process is not being carried out, the opening 10 of head piece 9, channel 34 and oil sleeve 64 do not fill with oil. When the rivet-pulling apparatus 18 clips on to the center rod 98 of rivet 97 at two plate components 96, the operator presses the trigger 48 leading the oil to push the flange 22 which pushes the driving sleeve 13 and rivet-pulling apparatus 18 move back, refer to the arrow direction. The head of rivet 97 expands to break the center rod 98 by the rivet-pulling process so that the plate components 96 are joined by rivet.

Figure 5:
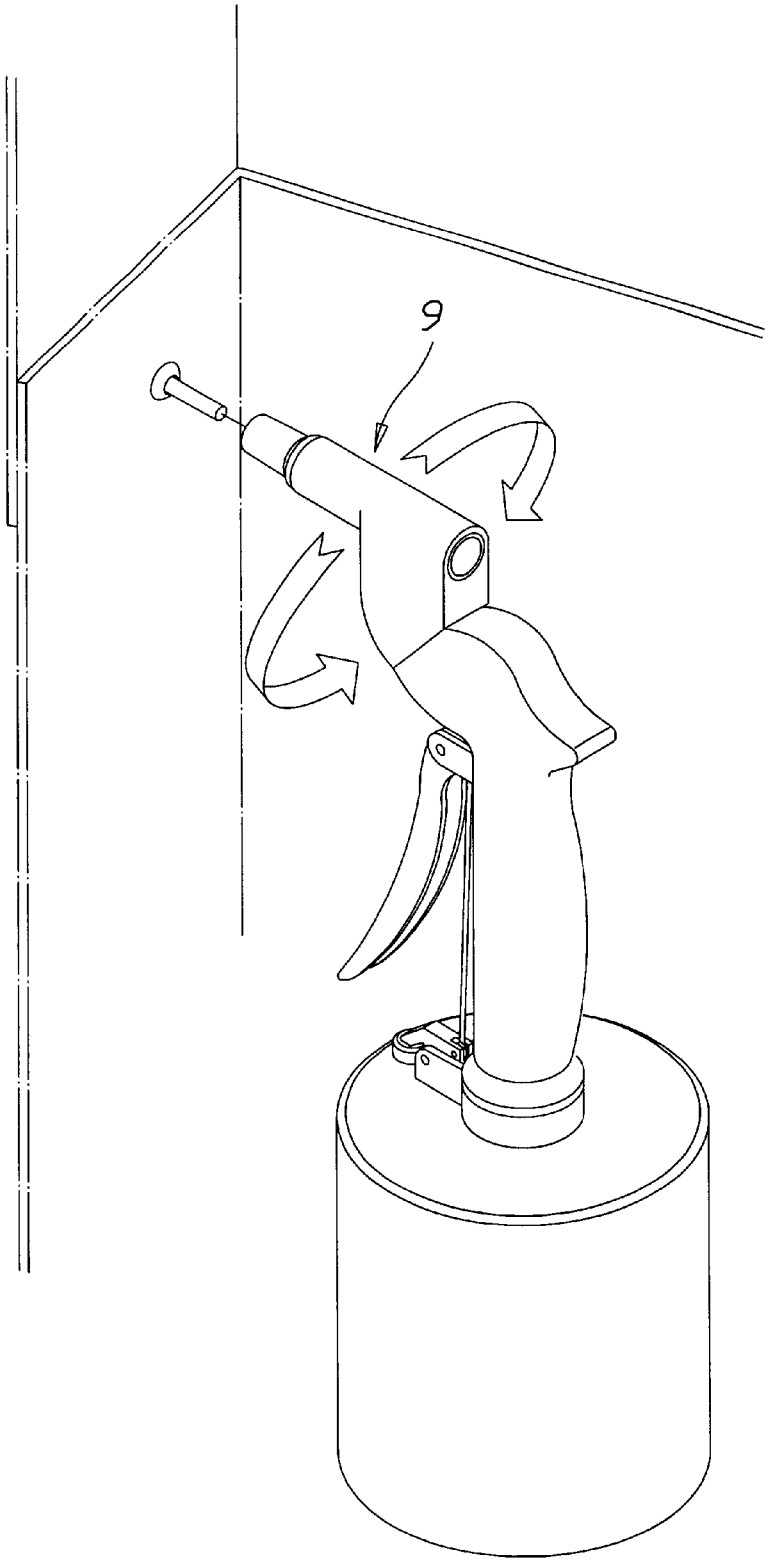
FIG. 5 is an illustrated view for the rotatable head piece working of the present invention.
Figure 6:
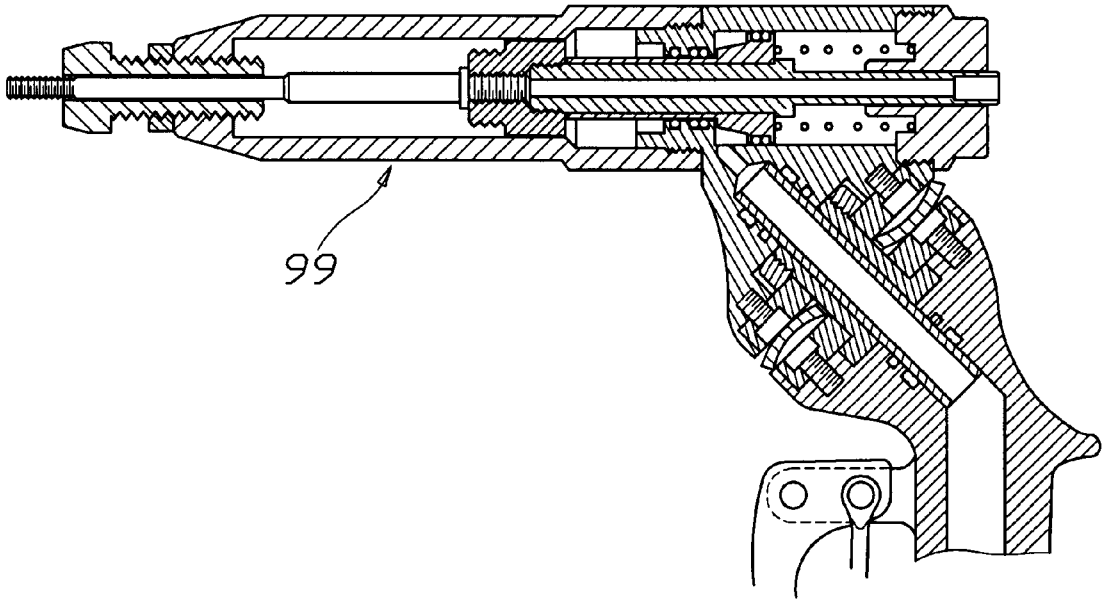
FIG. 6 is a perspective view for changing the rivet-pulling to the nut-pulling apparatus of the embodiments of the present invention.

Refer to FIGS. 5 and 6, the rotatable head 9 can rotate to accommodate the operational situation. Furthermore, the riveter can change the rivet-pulling apparatus to, for example, a nut-pulling apparatus 99, an anchor riveting apparatus, a bolt-pulling apparatus.

The air over oil riveter of the present invention discloses two rotatable members placed between the head piece and handle for providing a rotatable head of the riveter. The present invention improves the conventional riveter which cannot rotate the head thereof. Furthermore, the present invention can change the rivet-pulling apparatus to, for example, a nut pulling apparatus 99, which connects on the joint 17.

Figures 7A, 7B, 7C:
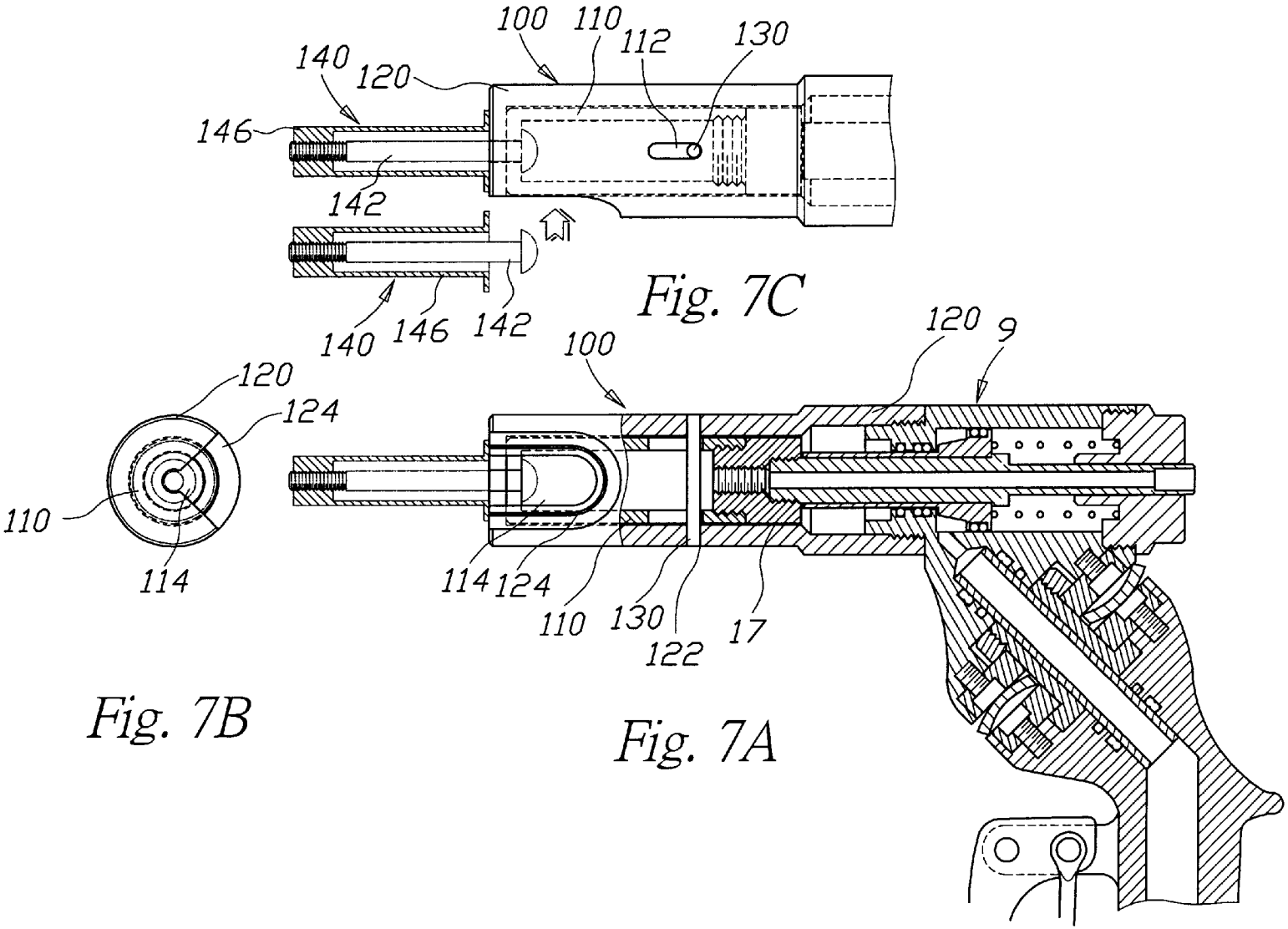
FIG. 7A illustrates a cross-sectional view of the replacement of an anchor riveting apparatus with a nut-pulling apparatus as an embodiment of the present invention.
FIG. 7B illustrates a left side view of an anchor riveting apparatus shown in FIG. 7A.
FIG. 7C illustrates a cross-sectional view of the movement of an anchor rivet mounted therein at an anchor riveting apparatus.

Refer to FIGS. 7A, 7B and 7C, as the user works on the combination of the plate components, the nut-pulling apparatus 99 shown in FIG. 6 can be replaced with an anchor riveting apparatus 100 by releasing the nut-pulling apparatus 99 from the joint 17. The anchor riveting apparatus 100 includes an inner sleeve 110 and an outer sleeve 120 which is separately tightened to the joint 17 and the front of head piece 9. The inner sleeve 110 is mounted into the outer sleeve 120 by a pin 130 which is positioned into the positioning hole 122 of the outer sleeve 120 and the sliding groove 112 of the inner sleeve 110. The inner sleeve 110 can easily slide inside the outer sleeve 120. A gap 114 of the inner sleeve 110 is then fitted into the gap 124 of the outer sleeve 120. The head of the central shaft 142 of the anchor rivet 140 is then positioned inside the inner sleeve 110 through the gap 114 and 124. The anchor rivet 140 is then mounted into the anchor riveting apparatus 100.

Figure 8:
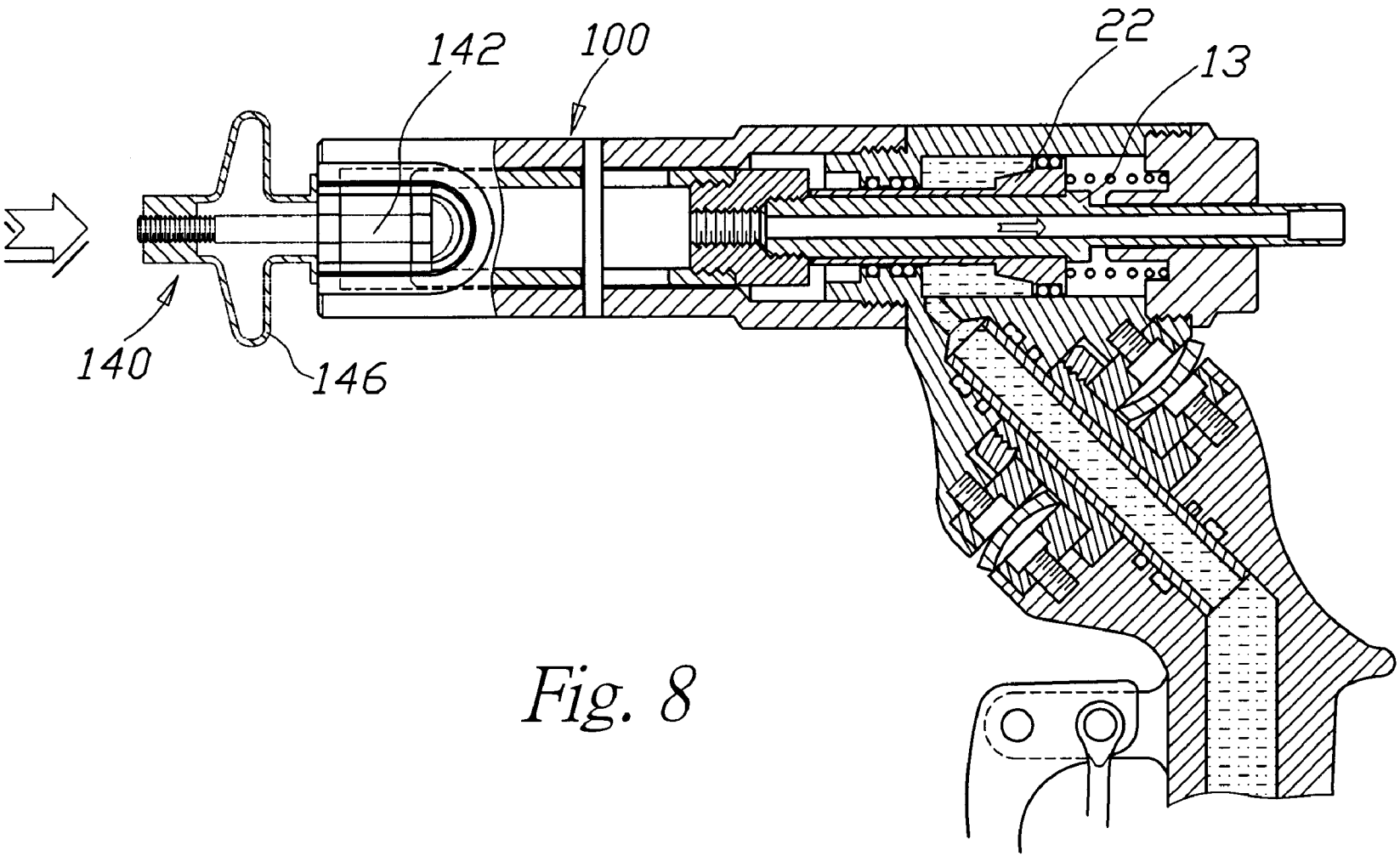
FIG. 8A illustrates a view of movement shown in FIG. 7A.

Referring to FIG. 8, as the operator grips the trigger 48, the flowing oil pushes the flange 22 and the driving sleeve 13 to move backwards. The movement of the driving sleeve 13 pulls the anchor riveting apparatus 100 to move backwards and pulls the center shaft 142 of the anchor rivet 140 back to deform the outer sleeve 146 of the anchor rivet 140 (the direction of the movement is shown by the arrow in the figure).

What is claimed is:

1. An air over oil riveter with a rotatable head piece, comprising:

a head piece having a first inclined plane at a bottom of the head piece, the inclined plane having a bottom hole, a channel, a driving sleeve, and an outer sleeve with a flange at a predetermined position and a bore for receiving the driving sleeve and connecting to the channel;

a handle having a second inclined plane at a front of the handle for correspondence with the first inclined plane, each of the first and second inclined planes having an oil path formed therein;

two rotatable members respectively coupled to the first and second inclined planes by screws and individually having a positional hole;

a connecting sleeve with a hollow passage and a screw thread at a front end and a flange at a rear end, the connecting sleeve passing though a front hole of the second inclined plane, the two rotatable members and a bottom hole of the first inclined plane for connecting the handle and head piece by a nut; and an oil sleeve with a hollow body passing through the hollow passage of the connecting sleeve for fluidly coupling the oil path of the handle to the channel for controlling the driving sleeve.

2. The air over oil riveter with a rotatable head piece of claim 1, further comprising a wave pad disposed between the two rotatable members.

3. The air over oil riveter with a rotatable head piece of claim 1, wherein a front of the driving sleeve is coupled to a rivet-pulling apparatus.

4. The air over oil riveter with a rotatable head piece of claim 1, wherein a front of the driving sleeve is coupled to a nut-pulling apparatus.

5. The air over oil riveter with a rotatable head piece of claim 1, wherein a front of the driving sleeve is coupled to an anchor riveting apparatus.

6. The air over oil riveter with a rotatable head piece of claim 1, wherein a front of the driving sleeve is coupled to a bolt-pulling apparatus.

7. The air over oil riveter with a rotatable head piece of claim 1, wherein a rear of the driving sleeve has a hex socket cap screw.

8. The air over oil riveter with a rotatable head piece of claim 1, wherein a wall of the bore tightly contacts the outer sleeve through at least one O-ring for preventing oil leakage.

9. The air over oil riveter with a rotatable head piece of claim 1, wherein the flange of outer sleeve tightly contacts a wall of the bore by at least one O-ring for preventing oil leakage.

10. The air over oil riveter with a rotatable head piece of claim 1, wherein a spring is disposed at a rear of the outer sleeve.

11. The air over oil riveter with a rotatable head piece of claim 1, wherein a frond and a rear of the oil sleeve respectively having at least one o-ring for preventing oil leakage.

12. The air over oil riveter with a rotatable head piece of claim 1, wherein the head piece further comprises a cover.

* * * * *